United States Patent [19]

Zoltner

[11] 3,950,092

[45] Apr. 13, 1976

[54] IMPELLER MEMBER FOR USE IN TRANSPORTING PARTICULATE MATERIAL IN A REPRODUCING MACHINE

[75] Inventor: John D. Zoltner, Rochester, N.Y.

[73] Assignee: Xerox Corporation, Stamford, Conn.

[22] Filed: Sept. 20, 1974

[21] Appl. No.: 507,907

[52] U.S. Cl. ..... 355/15; 118/637; 222/412; 355/3 DD

[51] Int. Cl.[2] ..... G03G 21/00

[58] Field of Search..... 355/15, 3 DD; 118/203, 118/312, 637; 222/410, 412, 414

[56] References Cited

UNITED STATES PATENTS

| | | | |
|---|---|---|---|
| 3,536,043 | 10/1970 | Eppe et al. | 118/312 X |
| 3,550,556 | 12/1970 | Chawda | 118/312 X |
| 3,641,979 | 2/1972 | Gerbasi et al. | 118/312 X |
| 3,654,901 | 4/1972 | Donohue et al. | 118/637 |
| 3,678,896 | 7/1972 | Hewitt | 118/637 |
| 3,838,472 | 10/1974 | Oriel | 355/15 X |

*Primary Examiner*—R. L. Moses
*Attorney, Agent, or Firm*—Paul Weinstein; Clarence A. Green; James J. Ralabate

[57] ABSTRACT

An impeller member, a cleaning apparatus utilizing the impeller member, and an electrostatographic reproducing machine utilizing the cleaning apparatus are provided for cleaning particulate material from the surface of a re-usable image retaining member and for transporting and storing the particulate material. The cleaning apparatus includes a cleaning device for removing the material from the surface of the image retaining member and a storage device for storing the material removed by the cleaning device. A transport device for transporting the material from the cleaning device to the storage device includes an impeller member having a first portion extending from an end thereof for moving the particulate material transversely of the storage device and a second portion of the member adjacent to the first portion for moving the material rearwardly into the storage device.

16 Claims, 5 Drawing Figures

IMPELLER MEMBER FOR USE IN TRANSPORTING PARTICULATE MATERIAL IN A REPRODUCING MACHINE

BACKGROUND OF THE INVENTION

This invention relates to an improved particulate material cleaning and storing apparatus and to a reproducing apparatus employing it. The cleaning apparatus is adapted to clean residual toner material, etc., from the surface of a reusable image retaining surface.

A wide variety of toner cleaning and storage systems have been devised in the prior art. In U.S. Pat. Nos. 3,740,789 to Ticknor, and 3,742,551 to Oriel, cleaning and storage apparatuses similar in many respects to that employed in the Xerox 3100 copier as described. A blade cleaning device is utilized to separate residual toner from the surface of a xerographic drum. The removed toner is then transported rearwardly into a sump by means of a seal roll and paddle wheel arrangement.

Yet another approach for cleaning and storing toner is described in U.S. Pat. Nos. 3,660,863 to Gerbasi, and 3,724,019 to Shanley. These patents are exemplary of a cleaning system similar in many respects to that employed in the Xerox 4000 copier wherein a blade cleaning means is utilized to remove toner from the surface of a xerographic drum. The removed toner is then transported by means of an auger to a conveying device whereby it is recirculated to the development system for reapplication to the xerographic surface.

The cleaning and storage apparatuses described in U.S. Pat. Nos. 3,740,789 and 3,742,551, employing non-recirculating sumps are particularly adapted for use in a compact reproducing machine such as the Xerox 3100 copier. The sumps described in these patents have a limited capacity and, therefore, periodically must be cleaned out. It has been found, however, that the period required between cleanings of the sump can be severely shortened depending on the mode in which the machine is operated and the configuration of the sump itself.

For example, when copying a document which does not cover the entire platen surface, and the platen is otherwise left uncovered, dense solid areas on one or both ends of the xerographic drum, depending on whether corner or center registration is employed respectively, develop out on the drum. This causes the sump to fill up unevenly. This problem can be further compounded by having a sump of uneven volume.

In the 3100 copier corner registration is employed so that such solid areas develop on the in-board end of the drum which in turn causes the in-board end of the cleaner sump to fill up before the out-board end. As will be described in greater detail hereafter, the sump configuration utilized provides a smaller sump volume on the in-board end in order to accommodate other elements of the machine. As a result the in-board side of the cleaner sump tends to overflow into the remaining machine environment after a given interval while the out-board side of the sump may be less than one-third full.

One approach which can partially solve this problem is described in U.S. Pat. No. 3,792,913 to Simmons. This patent describes a xerographic erase mechanism which is adapted to prevent the development out of the dense solid areas on the end of the drum. While this approach is effective to reduce the problem the present invention attacks the problem in a much simpler fashion and is also effective with sumps of uneven volume.

SUMMARY OF THE INVENTION

In accordance with this invention an apparatus is provided for cleaning residual particulate material from the surface of a reusable image retaining member, and for transporting and storing the residual particulate material. The apparatus includes a cleaning means for removing the material from the surface of the image retaining member and storage means for storing the material removed by the cleaning means. A transport means for transporting the material from the cleaning means to the storage means includes an impeller member having a first portion extending from an end thereof with means for moving the particulate material transversely of the storage means and a second portion of the member adjacent to the first portion having means for moving the material rearwardly into the storage means. The storage means preferably comprises a sump. Preferably the sump comprises part of a housing which supports the transport means and the cleaning means.

Preferably the means for moving the particulate material transversely of the sump comprises an auger-shaped portion of the member and the means for moving the material rearwardly into the sump comprises a paddle-like portion of the member.

A reproducing apparatus and preferably an electrostatographic reproducing apparatus employing the cleaning, transporting and storing apparatus is also provided.

The apparatus of this invention is particularly adapted to provide more complete filling of the sump to eliminate the problems previously described.

Accordingly, it is an object of this invention to provide an apparatus for cleaning, transporting, and storing residual particulate material.

It is a further object of this invention to provide an apparatus as above including impeller means with means for moving the material both rearwardly and transversely of the storage means.

It is a further object of this invention to provide a reproducing machine employing the above-noted cleaning transporting and storing apparatus.

These and other objects will become more apparent to those skilled in the art from the following description and drawings.

DETAILED DESCRIPTION OF THE PREFERRED EMBODIMENTS

Figure 1:
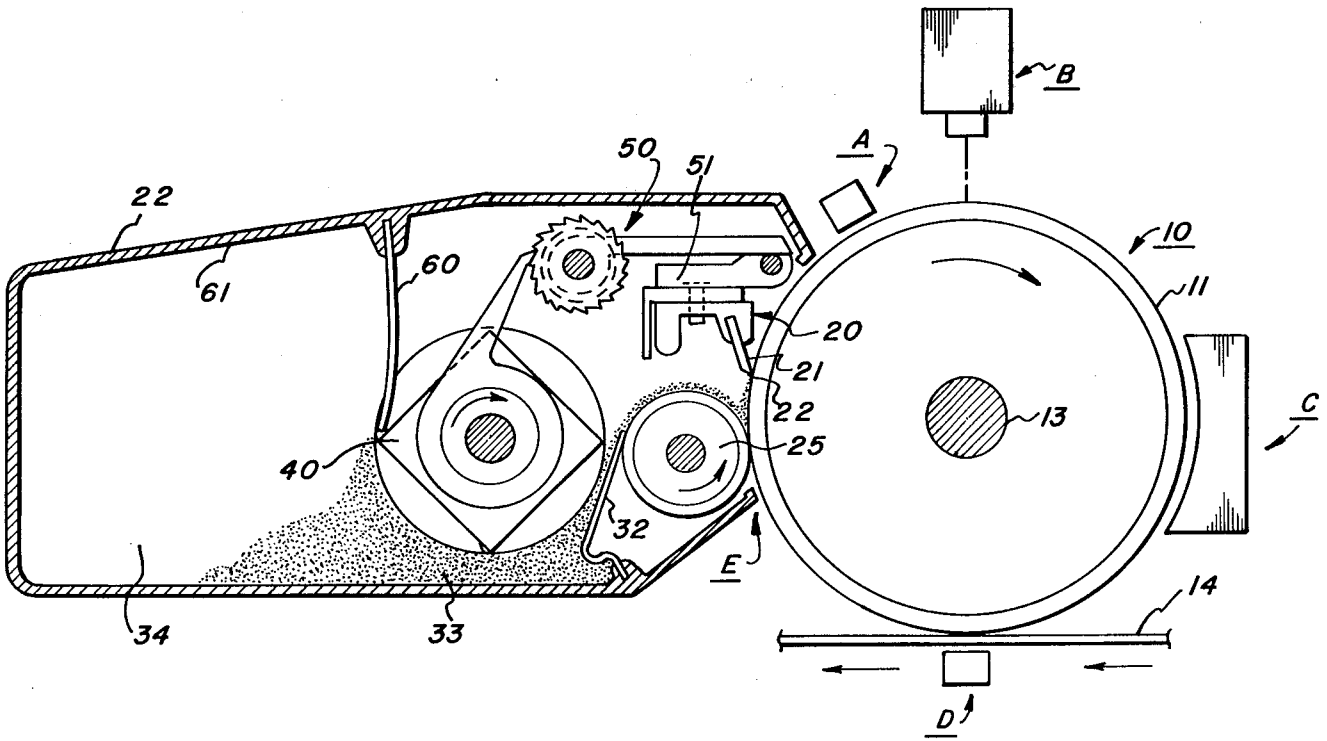
FIG. 1 is a schematic side view of a reproducing apparatus in accordance with the present invention.

Referring to the drawings, there is shown, for the purposes of explanation, an automatic xerographic reproducing machine incorporating the improved cleaning apparatus of the present invention. The copying machine employs a reusable image retaining member comprising a drum like member 10, the outer periphery of which is furnished with a suitable xerographic imaging or photoconductive layer 11 which is well known to those skilled in the art. Drum 10, which is suitably journaled for rotation in the machine by means of a shaft 13, rotates in the direction indicated in FIG. 1 to bring the image retaining surface 11 thereon past a plurality of xerographic processing stations. Suitable drive means (not shown) are provided to power and coordinate the motion of the various machine operating components whereby a faithful reproduction of the original input scene information is xerographically created.

Since the practice of xerography is well known in the art, the various processing stations for producing a copy of an original are herein shwon in block diagram form and are referred to as stations A through E. At station A, a uniform charge is placed upon the photoconductive surface of the drum member. The charged drum is then moved past an exposure station B for illuminating the charge surface with a light image of the original input scene information so that the charge is selectively dissipated in the light struck regions to record the original input scene information on the photoconductor in the form of a latent electrostatic image. Means for applying toner material to the image bearing surface is provided at station C whereby the latent image is rendered visible. The developed image is then brought into contact with a final support sheet 14 at transfer station D and the toner image transferred from the xerographic drum surface to the support sheet.

Finally, at station E, an improved cleaning apparatus, embodying the teachings of the present invention, acts to remove any residual toner material that might remain on the drum surface after the transfer operation and from the surface thereof and automatically stores the toner within a cleaning housing in a manner to be explained in greater detail below.

Figure 2:
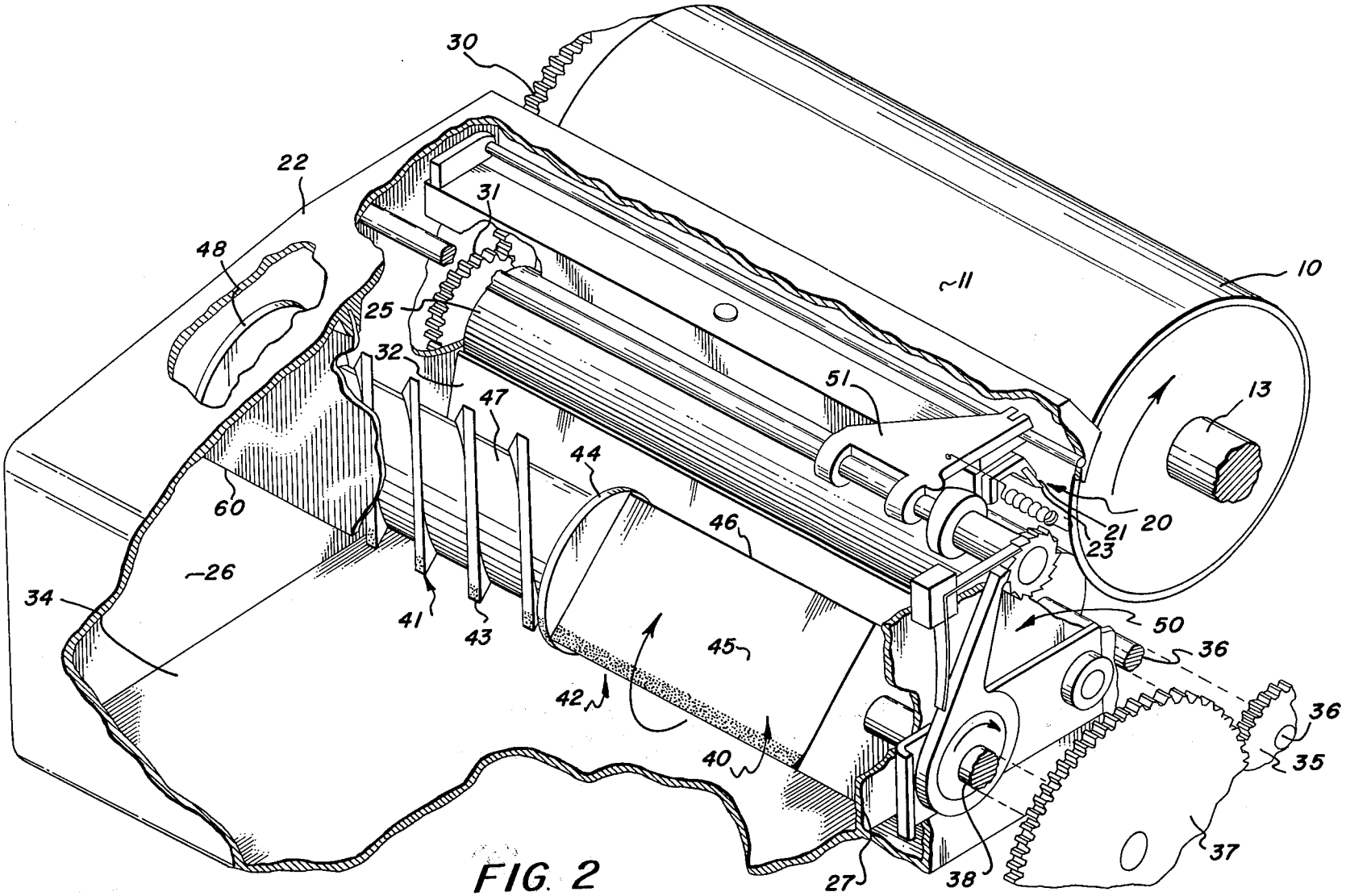
FIG. 2 is a perspective view partially broken away showing the cleaning, transporting, and storing apparatus of this invention.

The cleaning station E may include any desired cleaning means 20 for separating the particulate material from the surface of the image retaining plate. The cleaning means which is shown in FIGS. 1 and 2 includes a relatively flexible blade member 21. The blade is movably supported within the cleaning housing 22 so that it can be incrementally stepped back and forth across the drum surface over a predetermined path of travel with the edge 23 of the blade running in contact with the drum surface 11.

Further details concerning the blade cleaning means shown can be obtained by reference to previously noted U.S. Pat. Nos. 3,740,789 and 3,742,551. As illustrated, the blade member 21 is located above the horizontal center line of the drum 10 with the edge 23 extending downwardly in opposition to the upward movement of the photoconductive surface 11. As a consequence, the residual toner particles moving over the edge 23 of the blade are caused to fall downwardly toward the bottom of the cleaning housing 22.

A cylindrical seal roll 25 which is aligned parallel to the xerographic drum is located below the blade member 21 in a position to intercept the falling toner particles. The roll 25 is rotatably supported between the side walls 26 and 27 of the cleaning housing 22 and serves to collect the toner removed by the blade and transport it away from the photoconductive surface 11 and out of the cleaning zone. Further details concerning the cylindrical seal roll 25 can be found by reference to the previously noted U.S. Pat. Nos. 3,740,789 and 3,742,551.

The seal roll 25 which has been described rides in contact with the surface of the drum. Alternatively, however, an electrostatically charged seal roll spaced from the drum surface could be utilized in a manner similar to that set forth in U.S. Pat. No. 3,634,077 to Sullivan.

A pair of cooperating gear members 30 and 31 are provided through which the motion of the sealing roll 25 is coordinated with that of the xerographic drum 10. A scraper bar or blade 32 rides in light pressure contact with the surface of the sealing roll 25 and is arranged to separate the residual toner particles from the surface of the roll. In operation the residual toner particles are driven over the backside of the scraper bar 32 and fall into a collecting region 33 located in the bottom of the housing. The toner in the collecting region is transported rearwardly into a sump 34 in the rear portion of the cleaning housing by means of an impeller member 40. In accordance with the preferred embodiment shown in the Figures, the impeller member comprises an auger paddle member which extends transversely across the cleaning housing 22 and is rotatably supported between the housing sidewalls 26 and 27. It is arranged to rotate in an endless path of travel through the collecting area 33.

Although the paddle member 40 can be constructed of any suitable material, it is preferred that it be made of a plastic material exhibiting good release properties in relation to the particulate material it is transporting. Although not shown, a side seal can be provided between the ends of the paddle member and the side walls of the housing to prevent toner particles from moving therebetween.

In practice the auger paddle member 40 serves as a means for transporting toner out of the collecting area 33 and into the horizontally aligned storage means or sump 34 of the cleaning housing. As illustrated in FIG. 2, a drive pinion 35 is secured to the seal roll shaft 36 and meshes with a gear 37 operatively connected to the paddle member drive shaft 38. The movement of the auger paddle member is, therefore, coordinated through the gear system so that the paddle is moved at a speed sufficient to handle the toner that is delivered into the collecting area by the sealing roll.

To enhance the cleaning efficiency of the blade 21 and to avoid or at least considerably reduce localized wear on the blade edge 23 as well as substantially eliminate entrapment of foreign matter between the blade and the drum surface, the doctor blade is periodically stepped in pre-determined increments back and forth across the drum surface by means of a drive mechanism 50 and movable carriage 51 substantially as described in the previously noted U.S. Pat. Nos. 3,740,789 and 3,742,551.

As previously described, when copying a document which is smaller than the area being copied, dense solid areas on one or both ends of the xerographic drum can develop out. For example, if a document is corner registered then the solid area will develop out on one end of the xerographic drum 10. On the other hand, if the document is center registered, solid areas will develop out on both ends of the drum 10. The dense solid areas which develop out after transfer leave a considerable amount of residual toner on the ends of the drum which is then cleaned from the drum cleaning means 20. This results in an excess of toner being cleaned from the drum 10 at one or both of its ends, and a consequent uneven filling of the storage sump 34 of the cleaning housing 22.

Figure 3:
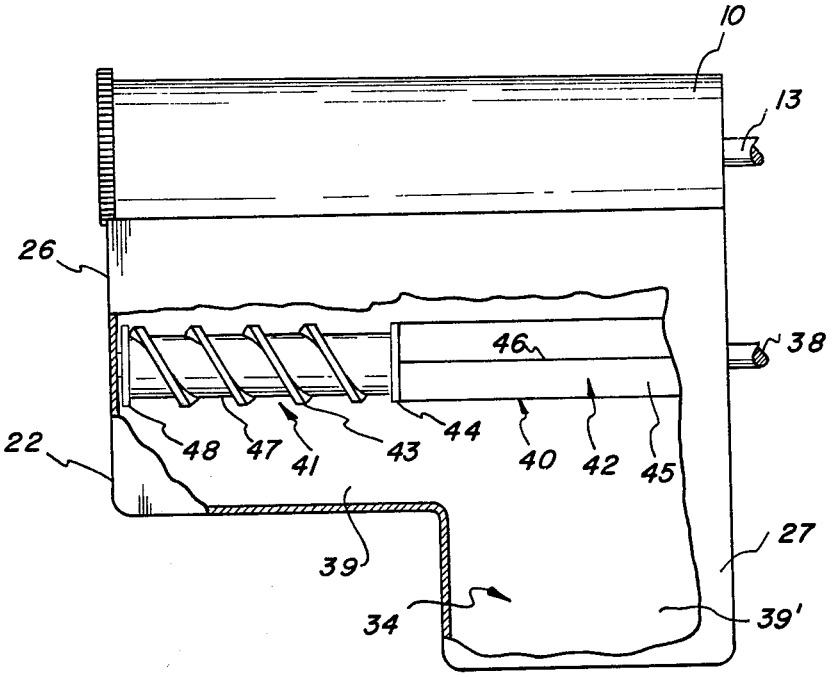
FIG. 3 is a partially cut away top view of the apparatus of the present invention.

The problem is further complicated and another problem results when as illustrated in FIG. 3, the sump 34 itself has an uneven volume. As shown therein, the section 39 of the sump 34 on one side of the housing 22 has a considerably smaller volume than the section 39' of the sump on the other side. Therefore, it is apparent that the use of such a sump would require more frequent cleaning intervals to prevent it from being overfilled in the small volume side even though the large volume side might have a considerable volume left to be filled.

While it is not desirable to utilize a sump 34 of uneven volume as shown in FIG. 3, such an approach is often necessitated due to the requirements of the machine. It is desirable to provide the largest sump possible that will fit within the machine environment. However, for a compact machine, various components such as power supplies, etc., may restrict the volume available for the sump to a limited volumetric region so that a sump of uneven volume needs to be utilized. In accordance with this invention it is desired to provide an apparatus which can substantially reduce the problem of uneven filling of a cleaning sump due to the development of dense solid areas and further which can make the best use of a sump of uneven volume.

In accordance with this invention the impeller member 40 has a first portion 41 extending from an end thereof with means for moving the particulate material or toner transversely of the sump 34. A second portion 42 of the member 40 adjacent the first portion has means moving the material rearwardly into the sump. In the embodiment shown, the means for moving the material transversely of the sump comprises an auger 43. The means for moving the material rearwardly of the sump comprises a square paddle 42 having a configuration substantially the same as that described in the previously noted U.S. Pat. Nos. 3,740,789, and 3,742,551. The paddle portion 42 of the impeller member 40 operates exactly in the same fashion as that described in the patents noted.

Only one side of the impeller member 40 includes an auger portion 41 since the apparatus shown is intended for use in a side or corner registered machine wherein uneven filling occurs only at one side of the sump. It should be apparent that in a machine with center registration wherein uneven filling occurs at both ends of the drum that auger portions 41 could extend in from both ends of the impeller member 40 in accordance with this invention. In this case the helix of the auger on one side would be reversed as compared to the other side so that both augers would auger the particulate material toward the middle of the sump.

A flexible wall 60 is suspended in the top wall 61 of the cleaning housing 22 and extends downwardly in a substantially vertical direction so as to ride in contact with the impeller member 40. The flexible wall 60 is preferably fabricated from a relatively thin strip of Mylar which extends transversely across the interior of the housing 22 and provides a sealing wall capable of retaining the residual toner within the storage area.

The flexible wall member 60 is arranged to function as a cleaning expedient for removing impacted toner from the paddle portion 42 of the impeller member 40. The flexible wall also cooperates with the auger portion 41 of the impeller member 40 to provide efficient transport of the particulate material transversely or laterally of the sump 34.

The auger portion 41 of the impeller member is operative to transport the toner material transversely as described and also to a more limited degree rearwardly into the smaller volume section 39 of the sump 34. Toner captured between the flexible wall member 60 and the auger 41 is quite effectively transported transversely. Toner not so captured is driven rearwardly as well as transversely.

Figure 4A:
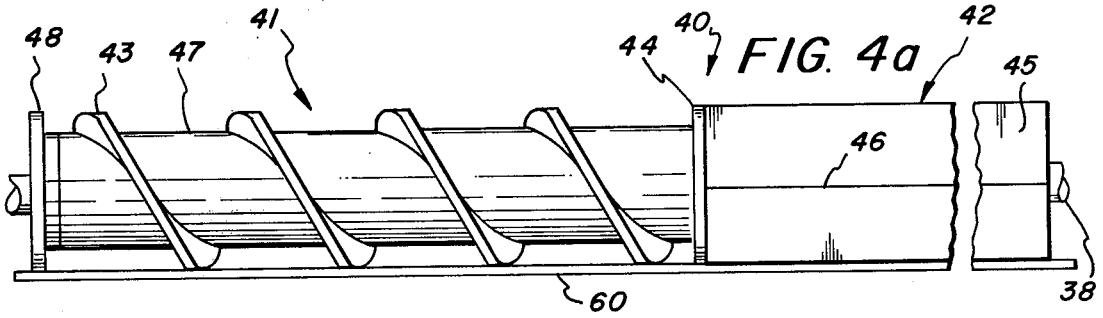
FIG. 4*a* and 4*b* are top views of the impeller member in accordance with this invention.
Figure 4B:
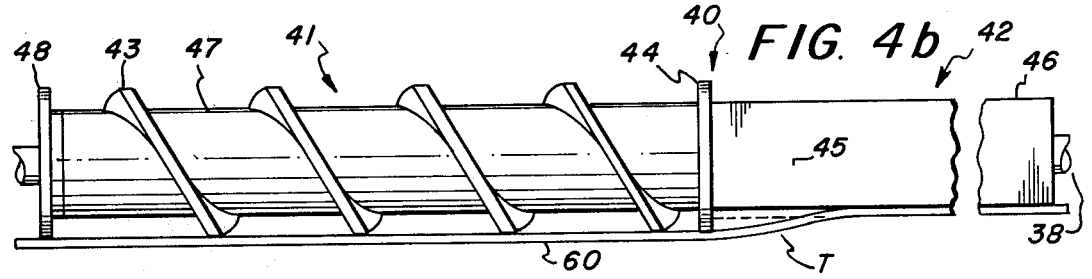

A single unitary flexible wall member 60 is preferred for use in accordance with the present invention. In the auger 41 shown, the outside diameter of the helical blade 43 has been selected to correspond to the diagonal width of the paddle 42. Therefore, the contact between the wall member 60 and the impeller member 40 is generally continuous against the auger blade 43. Referring to FIG. 4, the wall member 60 operates on the paddle substantially as described in the abovenoted patents except in the region T where the transition occurs from the auger 41 to the paddle 42. In this region, due to the cylindrical flange 44 at the end of the auger and the outer periphery of the blade 43, the wall member is lifted away from the immediately adjacent segment of the paddle 42 during the portion of the cycle when the side 45 of the paddle is adjacent the wall as in FIG. 4*b* rather than an edge 46 thereof as in FIG. 4*a*. While this would appear to be an undesirable effect, it has been found in practice to be highly desirable since it provides more efficient filling of the small volume section 39 of the sump 34.

The mechanism which causes these results is not understood.

The flexible wall member 60 could be split at the transition between the auger and the paddle as shown in phantom in FIG. 4*b*. This would provide continuous action over the entire paddle portion in the fashion of the abovenoted patents. In practice, this approach has been found to be undesirable since it results in the large volume side of the housing filling up while the small volume side does not. With a unitary wall 60 there may be leakage of toner between the wall member and the impeller member 40 in the region of the transition between the auger 41 and paddle portions 42 which somehow assists in filling the augered side of the sump 34.

As above-noted the paddle portion 42 of the impeller member 40 may be constructed substantially as set forth in the above-noted patents. The auger portion 41 may be constructed as desired to obtain the desired transverse transport. The auger shown comprises a cylindrical hub portion 47 with the blade 43 helically wrapped around the hub. Cylindrical flanges 44 and 48 are provided at each end of the augered portion. The cylindrical flange at the end adjacent to the side wall 26 of the housing serves to help seal the housing to prevent the particulate material from escaping into the remaining machine environment. The cylindrical flange 44 at the transition of the auger and paddle portions operates upon the flexible wall member to provide the desired leakage as previously described.

The blade portion 43 of the auger 41 shown has an inclination with respect to the axis of the auger of approximately 60°. The blades themselves extend out normally from the hub 47 of the auger and are approximately one-tenth of an inch in thickness. The height of the blades from the hub of the auger is approximately one-fourth of an inch. The diameter of the hub shown is approximately 1 inch.

An impeller member 40 having a construction substantially as described was substituted for the paddle member in the cleaning system of a Xerox "3100" copier. It was found to be effective for moving toner to the large volume side of the housing and thereby increase by a factor of approximately 3 the interval at which cleaning of the sump to remove the toner accumulated therein is required.

While the impeller has been shown utilizing a square paddle, paddles of other designs could be used in accordance with the present invention.

While a blade cleaning means has been described, any desired cleaning means could be employed including, but not limited to brush, web, foam roll, etc. Blade cleaning is preferred because it provides a highly compact and low power consuming cleaning system.

The use of a seal roll is preferred for the configuration disclosed, however, for other desired cleaning systems the transport means need not include a seal roll.

The patents described in this application are intended to be incorporated by reference into the application.

Transversely of the sump, as the term is utilized herein refers to a side 26 to side 27 direction and rearwardly into said sump, as the term is utilized herein refers to a front to back direction.

It is apparent that there has been provided in accordance with this invention a cleaning, transporting and storing apparatus and reproducing machine incorporating the same which fully satisfies the objects, means and advantages set forth hereinbefore. While the invention has been described in conjunction with specific embodiments therefore, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed:

1. An impeller member for use in a reproduction machine for receiving particulate material from a source thereof at a first position, and for transporting said material into a receiving means at a second and different position, said impeller member having a first portion extending from an end thereof having means for moving said material transversely of said receiving means, said first portion comprising an auger which moves said material axially inwardly of said member, said member having a second portion adjacent said first portion, said second portion having means for moving said material into said receiving means, said second portion of said member comprising a paddle.

2. An apparatus as in claim 1 wherein said paddle has a square cross-section.

3. An apparatus for cleaning, transporting and storing particulate material from the surface of a reusable image retaining member including: a cleaning means for removing said material from said surface; storage means for storing said material removed by said cleaning means; and transport means for transporting said material from said cleaning means to said storage means; the improvement wherein, said transport means includes an impeller member having a first portion extending from an end thereof, having means for moving said material transversely of said storage means and a second portion of said member adjacent said first portion, said second portion having means for moving said material into said storage means.

4. An apparatus as in claim 3, further including a housing for supporting said cleaning means, said transport means and said storage means, said housing including a pair of spaced apart opposing said walls and wherein said first portion of said member comprises an auger which moves said material inwardly of the side walls of said housing.

5. An apparatus as in claim 4, wherein said second portion comprises a paddle.

6. An apparatus as in claim 5, wherein said storage means comprises a sump and further including flexible wall means cooperatively engaging said impeller member for retaining said particulate material in said sump.

7. An apparatus as in claim 6, wherein said sump has a configuration with uneven volume, wherein the sump volume is greater on a first side than on a second and opposing side of said sump, and wherein said auger portion is arranged to transport said material from said second side to said first side.

8. An apparatus as in claim 7, wherein said paddle has a square cross-section and wherein said member includes a cylindrical flange positioned at the transition between said auger portion and said paddle portion.

9. An apparatus as in claim 5, wherein the outside diameter of said auger portion is greater than the width of said square, and wherein said wall means comprises a unitary strip like member engaging both said auger and paddle portions of said member.

10. In an electrostatographic reproducing apparatus including an image retaining member;

means for forming an electrostatic image on a surface of said member;

means for developing said electrostatic image by the application of particulate material thereto;

means for transferring said developed image to a sheet of final support material; and means for cleaning residual particulate material from said surface following transfer, said cleaning means including means for removing said material from said surface, storage means for storing said material removed by said cleaning means, and transport means for transporting said material from said cleaning means to said storage means;

the improvement wherein, said transport means includes an impeller member having a first portion extending from an end thereof having means for moving said material transversely of said storage means and a second portion of said member adjacent said first portion, said second portion having means for moving said material into said storage means.

11. An apparatus as in claim 10, further including a housing for supporting said cleaning means, said transport means and said storage means, said housing including a pair of spaced apart opposing side walls and wherein said first portion of said member comprises an auger which moves said material inwardly of the side walls of said housing.

12. An apparatus as in claim 11, wherein said second portion comprises a paddle.

13. An apparatus as in claim 12, wherein said storage means comprises a sump and further including flexible wall means cooperatively engaging said impeller member for retaining said particulate material in said sump.

14. An apparatus as in claim 13, wherein said sump has a configuration with uneven volume, wherein the sump volume is greater on a first side than on a second and opposing side of said sump, and wherein said auger portion is arranged to transport said material from said second side to said first side.

15. An apparatus as in claim 14, wherein said paddle has a square cross-section and wherein said member includes a cylindrical flange positioned at the transition between said auger portion and said paddle portion.

16. An apparatus as in claim 15, wherein the outside diameter of said auger portion is greater than the width of said square, and wherein said wall means comprises a unitary strip like member engaging both said auger and paddle portions of said member.

* * * * *